US005607226A

United States Patent [19]

Toth et al.

[11] Patent Number: 5,607,226

[45] Date of Patent: Mar. 4, 1997

[54] ILLUMINATED HOCKEY STICK

[75] Inventors: Christine Toth, Ventura; Terrance L. Bryson, Colton, both of Calif.

[73] Assignee: Z Tech, Ventura, Calif.

[21] Appl. No.: 659,875

[22] Filed: Jun. 7, 1996

[51] Int. Cl.[6] ..... F21V 33/00

[52] U.S. Cl. ..... 362/251; 362/102; 362/800; 362/253; 362/249

[58] Field of Search ..... 273/67 A, DIG. 24; 362/102, 234, 109, 800, 253, 252, 251, 249

[56] References Cited

U.S. PATENT DOCUMENTS

| | | | |
|---|---|---|---|
| 2,787,470 | 4/1957 | Barrus | 273/186 |
| 3,106,403 | 10/1963 | Kirkman | 273/186 |
| 4,075,467 | 2/1978 | Peterson | 362/31 |
| 4,148,096 | 4/1979 | Haas et al. | 362/102 |
| 4,206,445 | 6/1980 | Steinhauer | 340/321 |
| 4,226,163 | 10/1980 | Welcomer | 84/422 |
| 4,345,305 | 8/1982 | Kolm | 362/186 |
| 4,688,796 | 8/1987 | Wright | 273/68 |
| 4,846,475 | 7/1989 | Newcomb et al. | 273/DIG. 4 |
| 5,036,442 | 7/1991 | Brown | 362/102 |
| 5,226,718 | 7/1993 | Lin | 362/119 |
| 5,351,704 | 10/1994 | Hunnicutt | 135/66 |
| 5,370,390 | 12/1994 | Swanson | 273/DIG. 24 |
| 5,379,203 | 1/1995 | Marano | 362/102 |

FOREIGN PATENT DOCUMENTS

WO8800075 1/1988 WIPO .

*Primary Examiner*—Ira S. Lazarus
*Assistant Examiner*—Thomas M. Sember
*Attorney, Agent, or Firm*—W. D. English

[57] ABSTRACT

An illuminated hockey stick having a plurality of LED's coupled along each side of the shaft of the hockey stick which enables a method for playing the game of street hockey outdoors at night or in dimly lit conditions. Other equipment used to play the game includes an illuminated hockey puck and goal posts with small lights or diodes to improve visibility.

14 Claims, 2 Drawing Sheets

ILLUMINATED HOCKEY STICK

BACKGROUND OF THE INVENTION

1. Field of the Invention

This invention relates to the game of street hockey, and particularly to an improved hockey stick which will permit the game to be played at dusk or at night.

2. Description of the Prior Art

The game of street hockey as opposed to ice hockey is a popular pastime during the fall and winter months usually coinciding with the colder months, shorter days and the professional hockey season. Street hockey is typically played on an outdoor basketball court, tennis court, parking lots or on little traveled city streets. The object of the game is similar to that of ice hockey: to drive a puck into the opponent's goal with a hockey stick. The game can be played in street shoes and inexpensive roller skates although skates of the roller blade variety have dramatically increased the popularity of street hockey.

It is well known that the game is played either during weekends or after school before sunset. Because of the time of year in which the game is most popular, daylight to play the game, especially during school days, is at a minimum. Absent lights for illuminating the playing surface commonly found on basketball and tennis courts, street hockey can be difficult if not impossible. As daylight conditions progressively give way to night time, visibility deteriorates. Lack of visibility can be the cause of dangerous conditions if play is continued. Under dimly lit conditions, players attempt to distinguish between teammates and opponents and have difficulty judging distances from other players and their hockey sticks. Injury can occur quite easily if a player inadvertently steps into the path of another player's swinging hockey stick. Other injury can occur while players try to react properly to a hockey puck traveling at a high rate of speed. Although a game may begin in daylight many injuries have occurred attempting to play during dusk or at night before the game is concluded.

Although lighting systems for outdoor tennis and basketball courts could promote street hockey as well at night, many communities have insufficient funds to cover the substantial cost of installation and operation of such courts. Additionally, children may rather choose to play in their neighborhood streets closer to home where either no street lighting is available or where the street is only dimly lit.

The development of a method for permitting play of street hockey at night would represent a solution to a long felt need for additional playing time of a game enjoyed by many.

OBJECTS OF THE INVENTION

It is an object of this invention to provide an improved hockey stick which will improve visibility for players and provide a novel method for playing the game of street hockey at dusk, night, or any other dimly lit condition.

It is a further object of this invention to manufacture the invention economically, without sacrificing any of the performance characteristics associated with traditional hockey sticks.

Still a further object of the invention is to identify team members from opponents by the color of lights emanating from each player's hockey stick.

Yet another object of the invention is to provide a novel and uniquely identifiable hockey stick in dim light.

SUMMARY OF THE INVENTION

The novel method of playing the game of street hockey in lighting conditions less than optimal is accomplished through the incorporation of light emitting sources such as light emitting diodes (LED) or similar light emitters coupled in parallel along the length of a hockey stick. A battery positioned at the handle end of the hockey stick is used as a power source to illuminate the diodes on each improved hockey stick.

It is envisioned that players can add accessories to the illuminated hockey stick depending on how much they can afford to spend on equipment. Some of the accessories which could be illuminated by LED's or other light emitting means and powered by a battery source or other means would include the hockey puck, goal nets, helmets and articles of clothing such as uniforms or arm patches.

Other features and advantages of the invention will become apparent to those skilled in the art upon review of the following detailed description and claims.

DETAILED DESCRIPTION OF A PREFERRED EMBODIMENT

The illuminated hockey stick provides for a method of playing street hockey during limited lighting conditions and incorporates the use of light emitting diodes (LED)'s operated by a battery power source which is fitted into the handle of the improved hockey stick located at a distal end, opposite to the blade end.

Figure 1:
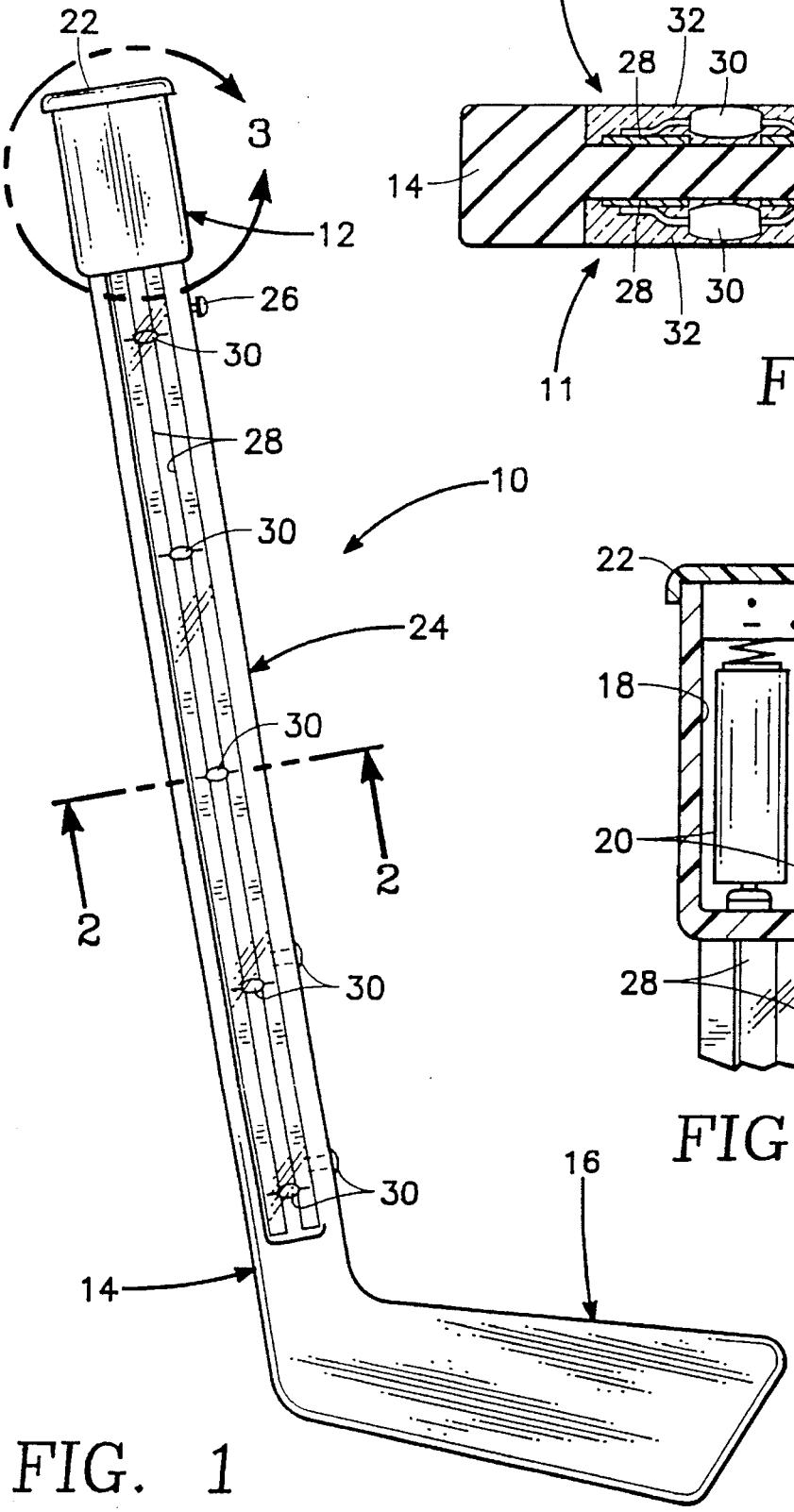
FIG. 1 is a schematic view of a hockey stick to be used for play in dimly lit or night time conditions.
Figure 2:
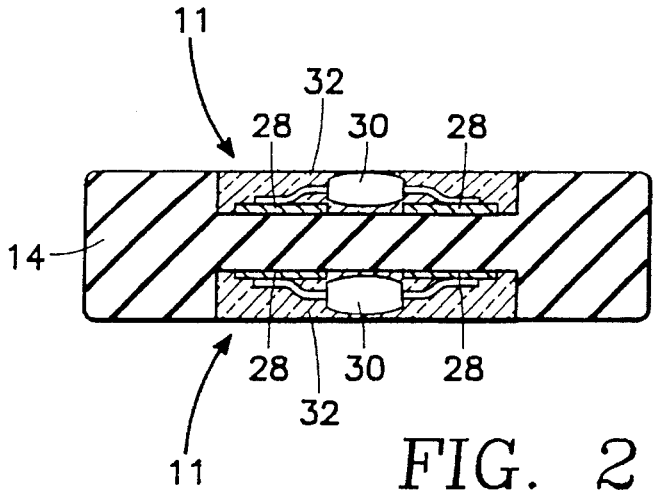
FIG. 2 is a view of hockey stick taken along line A—A of FIG. 1.
Figure 3:
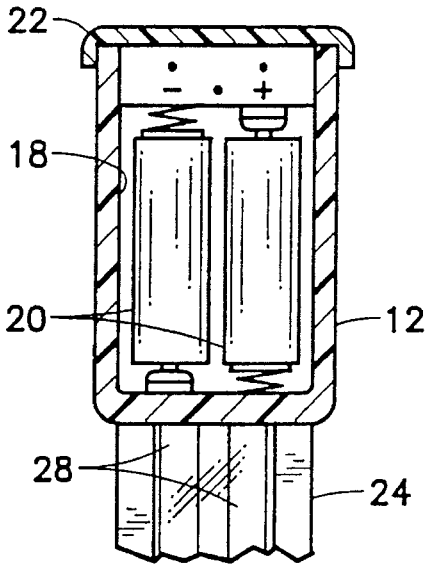
FIG. 3 is an exploded view of the handle portion of the hockey stick containing the power source.

With reference to FIG. 1, hockey stick 10 and the various components are illustrated. The preferred hockey stick is made from a piece of wood having a longitudinal recess 11 on two opposing sides of the shaft 24 generally from the handle 12 to the neck 14 of the blade end 16. Handle portion 12 of the stick has a receptacle 18 which can accept two AAA size 1.5 volt batteries 20. A flexible and removable handle cover 22 covers receptacle 18 and provides a water tight seal about shaft 24 below receptacle 18. Preferably, cover 22 is made of a plastic or rubberized flexible material. Alternatively, shaft 24 may be manufactured of any similarly strong and flexible material such as anodized aluminum with a non conductive surface or fiberglass. The blade end portion 16 can be made of a piece of wood integral with shaft 24 or more preferably, it is made of a hardened plastic material and attached to shaft 24 through the use of screws or other similar connecting means. The hardened plastic blade has the advantage over a traditional wood blade in that it is more wear resistant on playing surfaces such as asphalt or concrete. A passage channel (not shown) may be manufactured into shaft 24 and utilized to allow passage of wires or electrical conductors, or access to an externally activated switch 26 when the handle cover 22 is covering receptacle portion 18.

In the preferred embodiment of the illuminated hockey stick, two parallel electrically conductive foil strips 28 run the length of shaft 24 and lay along opposite sides of the passage channel diameter to open and close a circuit forming at that location. Conductive strips 28 form parallel conductors, which when shorted in two or more places become an electrical circuit. Light emitting devices (LED) 30 bridge strips 28 at various positions along the longitudinal length of shaft 24. Soldering of LED's 30 is the preferred method of bridging strips 28 although other methods may be suitably employed.

Conductive strips 28, LED's 30 and a battery source may be added to the exterior of a traditional hockey stick and then coated to prevent corrosion and undesirable resistance. A suitable coating would be either a spray lacquer (epoxy)or a similar coating exhibiting flexible and transparent characteristics. Preferably, conductive strips 28 and LED's 30 are disposed in recesses 11 during manufacture of the hockey stick and thereafter permanently positioned in place by application of transparent lamination. Conductive strips are preferably copper foil or some equally flexible and conductive material which may be applied to the stick during or after construction. An alternate material for conductive strips 28 is lead aluminum alloy foil tape; as used in alarm systems.

Although conductive foil strips are preferably used, there is no limitation on the type of electrical connecting means utilized. As an example, copper wire may be adequately used as a substitute for copper foil tape.

The preferred illuminated hockey stick 10 has two sets of light emitting devices 30 each set having a different illumination color from the other set; however, in alternative embodiments, it is conceived that all lights could be the same or any number of multiple colored diodes. The purpose of the two sets of colors is to distinguish members of one team by one color and the opponent team members by the other color. A switch 26 coupled to battery 20 at handle end 12 of shaft 24 permits players to select one color or the other. In this manner, one stick can be used by players on either side simply by selecting the proper switch position.

It is also conceived that connecting means running along either side of the hockey stick can consist of two or more parallel strips 28 depending upon whether LED's of only one color set will be positioned per side or both color sets will be positioned on each side respectively. In the preferred embodiment, two parallel strips 28 extend along each recess 11 on opposite sides of shaft 24. Operable switch 26 will permit illumination of one color on each side of shaft 24. There is no limit to the number of LED's 30 to position per side but preferably, 5 LED's per side are utilized. Further, at least one emitting device 30 for each color is preferably located on the side of the shaft facing the direction which the blade is extending away from the shaft. Each LED 30 located on the side facing the blade end is connected to battery 20 by extension of foil conductor strips 28 to their respective diode. These emitting devices are preferably located near neck 14 of blade end 16.

Figure 4:
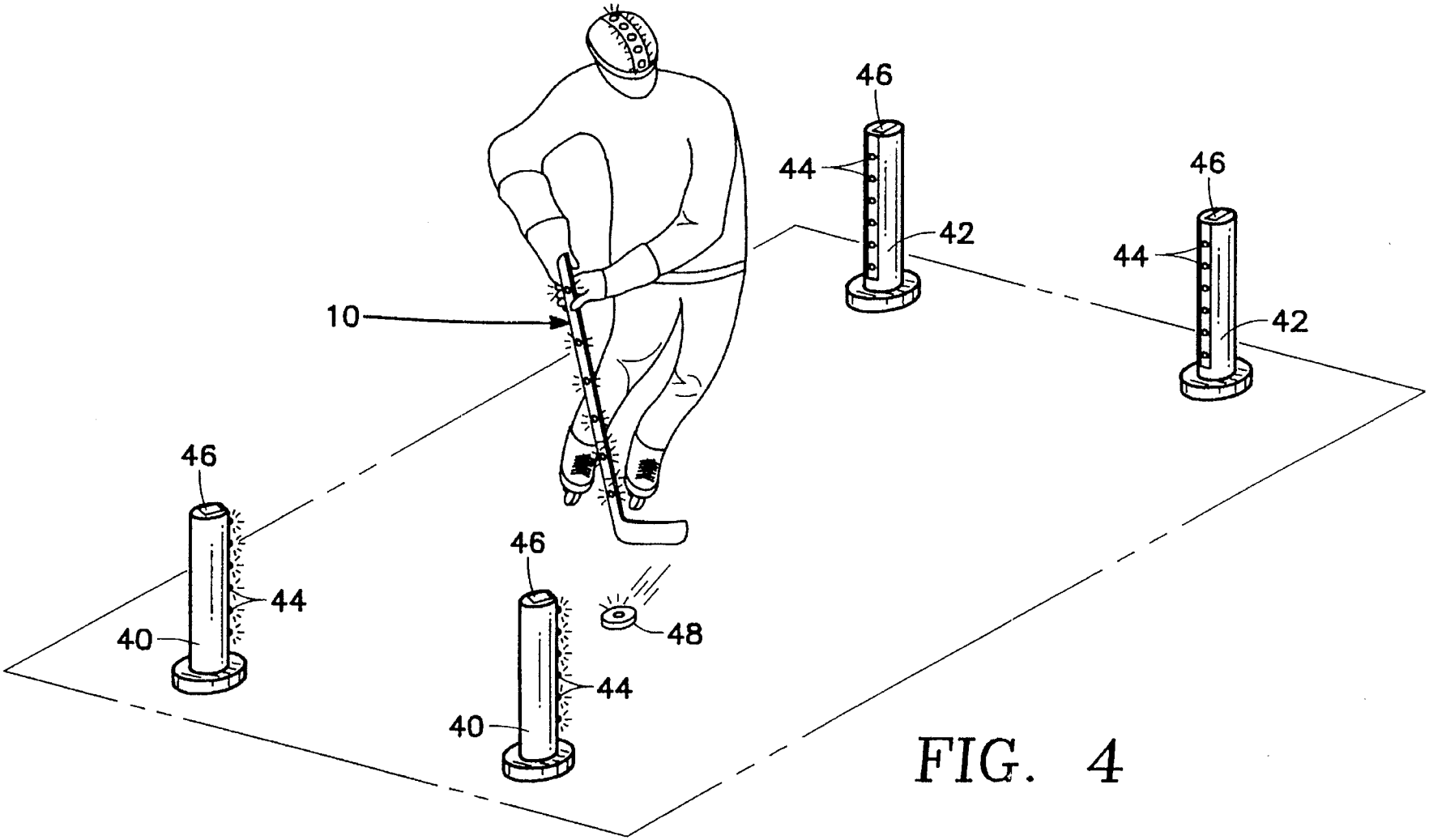
FIG. 4 is a perspective view of the night time, street hockey embodiment of the invention illustrating illuminated hockey goal posts and an illuminated hockey puck in addition to the illuminated hockey stick.

FIG. 4 illustrates the additional features of the invention including a first and second pair of goal posts 40 and 42, illuminated by at least one string of LED's 44 disposed along one side thereof or along the inside of a transparent goal post, powered by a switch and battery in recessed compartment 46 on top each of the posts. An illuminated hockey puck 48 is also included that may be illuminated by LED or other conventional means to compelment the illuminated hockey sticks 10.

We claim:

1. An illuminated hockey stick comprising:

a hockey stick having a shaft, a blade end and an end distal from said blade end defining a handle end;

a pair of longitudinal recesses generally extending from said handle end along said shaft to a neck of said blade end, said recesses located on opposite sides of said shaft;

a removable power supply located at said handle end;

a removable watertight end cap disposed about said power supply;

at least one conductive lead disposed longitudinally within each of said recesses;

a plurality of light emitting devices connected along said conductive lead;

a switch coupling said power supply to said conductive lead such that a conductive circuit may be made and broken by said switch; said switch capable of permitting a circuit with a first and second plurality of light emitting devices but only one plurality at a time; said first plurality of light emitting devices having a first illumination color and said second plurality of light emitting devices having a second illumination color which is different than said first color.

2. A hockey stick having a handle, a shaft and a blade adapted for increased visibility of said shaft, the improvement comprising:

a first plurality of light emitting devices positioned longitudinally along a first side of said shaft;

an energy supply attached to said shaft; and first means for conductively connecting said first plurality of light emitting devices to said energy supply to form a first electrical circuit and thereby cause said light emitting devices to illuminate.

3. The improvement as recited in claim 2 wherein said first means is a plurality of parallel conductive foil strips.

4. The improvement as recited in claim 2 further comprising at least one light emitting device coupled to said first means and located on a side of said shaft facing a direction that said blade of said hockey stick extends from said shaft.

5. The improvement as recited in claim 2 further comprising a switch connected to said power supply such that a conductive circuit may be made and broken by said switch.

6. The improvement as recited in claim 5 further comprising:

a second plurality of light emitting devices positioned longitudinally along a second side of said shaft opposite to said first side;

second means for connecting said second plurality of light emitting devices to said energy supply to form a second electrical circuit;

said second plurality of light emitting devices having an illumination color different from the illumination color of said first plurality of light emitting devices; and said switch capable of forming a circuit with either said first or said second plurality of light emitting devices.

7. The improvement as recited in claim 6 wherein said switch is capable of forming a circuit with only one plurality of light emitting devices at a time.

8. The improvement as recited in claim 6 wherein at least one first light emitting device is coupled to said first plurality of light emitting devices and having a distinctive color indicative of said first plurality and at least one second light emitting device is coupled to said second plurality of light emitting devices and having a distinctive color indicative of said second plurality.

9. The improvement as recited in claim 6 wherein said first and second plurality of light emitting devices and said first and said second connecting means are disposed respectively within longitudinal recesses formed in a surface of said hockey stick shaft and bonded within said recesses by a transparent layer of hardened polymer resin.

10. The improvement as recited in claim 2 wherein said power supply comprises a battery removably attached to said handle end of said stick.

11. The improvement as recited in claim 2 wherein said power supply can be protected from water contact by a removable end cap disposed about said power supply and providing a water tight seal to said hockey stick shaft.

12. The improvement as recited in claim 2 wherein said plurality of light emitting devices and said connecting means are disposed within a longitudinal recess formed in a surface of said hockey stick shaft and bonded within said recess by a transparent layer of hardened polymer resin.

13. An improved method for playing street hockey at night using conventional playing equipment, a hockey stick, hockey puck and goal posts, which are useable during daylight play as well, the improvement comprising:

providing a plurality of light emitting devices (LED) along the shaft of the hockey stick;

providing at least one LED in said hockey puck; and providing at least one LED in each said goal post.

14. A method as in claim 13 wherein said light emitting devices are light emitting diodes.

* * * * *